US005573148A

United States Patent [19]

Poole et al.

[11] Patent Number: 5,573,148

[45] Date of Patent: Nov. 12, 1996

[54] AIR POWERED CAULKING APPARATUS

[76] Inventors: C. Allen Poole, 423 Lee Vaughan Rd., Simpsonville, S.C. 29681; Bonner N. York, 102 Weatherby Dr., Greenville, S.C. 29615

[21] Appl. No.: 359,032

[22] Filed: Dec. 16, 1994

[51] Int. Cl.[6] ..... B67D 5/54

[52] U.S. Cl. ..... 222/611.1; 222/612; 222/399

[58] Field of Search ..... 222/611.1, 611.2, 222/612, 626, 399

[56] References Cited

U.S. PATENT DOCUMENTS

| | | | |
|---|---|---|---|
| 1,956,144 | 4/1934 | Brown | 222/636 |
| 2,878,025 | 3/1959 | Wilson | 222/626 |
| 3,129,852 | 4/1964 | Mower | 222/626 |
| 3,135,430 | 6/1964 | Caldwell | 222/626 |
| 3,208,643 | 9/1965 | Phillips | 222/626 |
| 3,540,632 | 11/1970 | Clingan | 222/626 |
| 3,687,102 | 8/1972 | Dunn . | |
| 3,813,012 | 5/1974 | Laird . | |
| 3,940,065 | 2/1976 | Ware et al. | 222/626 X |
| 4,089,446 | 5/1978 | Logan, II et al. | 222/626 X |
| 4,182,264 | 1/1980 | Gibson et al. . | |
| 4,505,410 | 3/1985 | Coulter . | |
| 4,508,245 | 4/1985 | Houlbrook et al. . | |
| 4,535,920 | 8/1985 | Troup | 222/612 |
| 4,629,094 | 12/1986 | Vogel et al. | 222/612 X |
| 4,630,965 | 12/1986 | Nguyen et al. | 222/611.1 X |
| 5,203,507 | 4/1993 | Matthews . | |

*Primary Examiner*—Andres Kashnikow
*Assistant Examiner*—Kenneth Bomberg
*Attorney, Agent, or Firm*—Hardaway Law Firm, PA

[57] ABSTRACT

An apparatus and method for caulking a large surface area with a large caulking apparatus is provided. A caulking tank is mounted on a frame which is connected to a source of air and to a nozzle assembly. The caulking tank includes a lid, an air inlet, a pressure release vent and an outlet. A valve is operatively connected between the caulking tank and the air source, which is a compressor and an air tank, for opening and closing the air pathway. The caulking material is dispensed by opening the valve and allowing air to enter the caulking tank and force the caulking material through the opposite end of the tank where it communicates through a hose to a nozzle assembly. The nozzle is pivotally mounted to the frame and it contains an adjustment rod for adjusting the angle of the nozzle.

19 Claims, 2 Drawing Sheets

AIR POWERED CAULKING APPARATUS

FIELD OF THE INVENTION

The following invention relates to a material dispensing device contained on wheels with a guiding system for controlled discharge of a caulking compound or flowable sealant materials such as urethanes, epoxies, and other semi-solid materials, into expansion joints or cracks. The apparatus is preferably used for dispensing caulking under air pressure into joints of concrete, such as those found in concrete floor structures.

BACKGROUND OF THE INVENTION

Currently, individuals use hand held caulkers or squeeze bottle dispensers to fill joints with caulking. These same caulkers are used to fill a large number of joints or cracks and thereby require large amounts of caulking compound. Conventional devices require many man-hours to cover a large area and require the user to either bend over or to get down on the floor to caulk a joint. The instant invention allows an individual to efficiently caulk a large number of joints while standing erect and without wasting caulking compound.

Devices for dispensing crease setting compositions are illustrated in U.S. Pat. Nos. 4,508,245 to Houlbrook et al., 4,505,410 to Coulter and 4,182,264 to Gibson et al.

The patent to Houlbrook et al. teaches the use of a wheeled device pulled along a crease of a garment. Through a worm-gear and pinion arrangement, turning of the wheel (roller) as the device travels causes rotation of a shaft that pushes a piston to expel the composition.

The patent to Coulter discloses a device substantially similar to that of Houlbrook et al., except that this device is provided with a lever arrangement to prevent composition from oozing out when the device is not in use.

The patent to Gibson et al. discloses a similar device wherein a spring arrangement is used in conjunction with a pivotally-mounted cover to prevent oozing.

The dispensers for crease-setting compositions are not air powered, nor do they suggest the use of air power to expel the compositions. These patents do not teach the use of a guiding means such as follower rollers to guide the apparatus.

In U.S. Pat. No. 3,813,012 there is disclosed an air powered caulking gun. The pistol grip of the caulking gun is hollow, housing an air inlet conduit and an air exhaust conduit A trigger pinches either conduit against respective pins to selectively control air flow into the piston driving chamber.

This patent fails to teach a device mounted on a wheeled base, the use of followers to set the direction of the apparatus, nor the application of caulking over a wide area.

In U.S. Pat. No. 3,687,102 to Dunn, a machine is disclosed for applying dust control fluid to fabric items such as mops, rugs, and mats. Fabric passes underneath a roller attached to an arm communicating with an actuating arm, thereby actuating a valve means to cause expulsion of fluid from a manifold onto the fabric in an atomized form. The fluid is supplied by a pump from a tank to the manifold.

The patent to Matthews U.S. Pat. No. 5,203,507 teaches the use of an air powered dispenser that may be mounted on wheels (FIG. 4). It uses a $CO_2$ canister or a positive displacement pump to deliver the pressure.

The device is similar to the instant invention in that it is on wheels, and an air-driven piston injects the composition into a nozzle, however, many differences are also present. Matthews fails to teach the use of a valve interposed between an air source and a caulking tank, an air tank having means to support a caulking tank and to pivotally support a nozzle, and a handle attached the air tank to control the apparatus.

None of the prior art teaches or suggests a combination wherein an air-powered caulking apparatus and a supplying reservoir are mounted to a wheeled base for distributing caulking in a guided linear manner into joints of concrete. None of the prior art addresses the problem of applying large volumes of caulking compound to joints in concrete or other building material.

SUMMARY OF THE INVENTION

The instant invention is distinguished over the known prior art in a plurality of ways. In essence, the invention includes an caulking dispenser mounted on a frame with wheels and a guiding system. Applicants are using "caulking" generically wherein it could be any flowable sealant material such as urethanes, epoxies, or other semi-solid materials. At one end of the frame, a handle is attached which extends back over the frame and upward so that a person may walk behind and control the apparatus.

A caulking tank is mounted on the frame which is connected to a source of air and to a nozzle assembly. The caulking tank includes a lid with an air inlet, an outlet and may optionally contain a piston adapted to move within the tank. As air enters the tank the material such as caulking compound is forced out of the tank under air pressure, the caulking material is dispensed out an opposite end of the tank where it communicates through a hose to the nozzle assembly. The nozzle is mounted to the frame and carried by an adjustment rod for adjusting the angle of the nozzle.

At the other end of the caulking tank, a hose connects the tank to a pressurized air source. The air source may be an air compressor and/or a compressed air tank. Between the tank and the air source, a valve is coupled for adjusting the pressure and thus the flow rate of the caulking.

Wheels are attached at the bottom of the frame to assist in moving the device, and follower rollers are also attached to help in following the joint. Alternatively, wheels may be mounted on the side to follow and fill a wall-floor joint.

Preferably, the device is self-propelled by a motor to enable selection of a desired speed, however, it may be manually pushed. In the primary embodiment the motor is electric and in a secondary embodiment it has a gas powered engine. The same power source both propels the device and powers the air compressor.

Accordingly, it is a primary object of the present invention to provide a novel and useful air powered and guided dispenser for dispensing caulking.

Another object of the present invention is to provide a novel caulking dispenser to caulk large number of joints with less operator fatigue. The instant invention accomplishes this in part by using a base with wheels to facilitate movement of the device.

It is still a further object of the present invention to provide a novel caulking dispenser to efficiently dispense large volumes of caulk and fill extensive joints by having a means of self propulsion. This is to distribute an even amount of caulking in the joints.

It is still a further object of the present invention to provide a novel caulking dispenser with a break away nozzle to prevent damage to the apparatus.

It is still a further object of the present invention is to provide a novel caulking dispenser to efficiently caulk a large number of joints. The instant invention accomplishes this by using a base with wheels and a guiding means to follow a joint or crevice.

It is still a further object of the present invention is to provide a novel caulking dispenser with a caulking tank that allows caulking to be poured, mixed or placed into the caulking tank.

DESCRIPTION OF THE PREFERRED EMBODIMENTS

Figure 1:
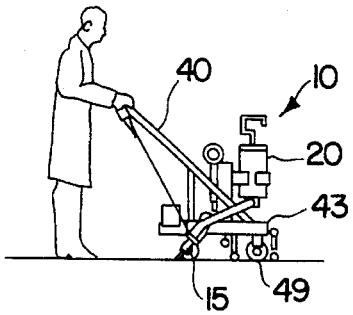
FIG. 1 is a perspective view of one embodiment of the invention in use.

Referring to the drawings now, wherein like reference numerals refer to like parts throughout the various drawing figures, reference numeral 10 is directed to the air powered caulker for dispensing caulking.

In essence, and with particular reference to FIG. 1, the air powered caulker 10 includes a tank assembly 20 connected to a nozzle assembly 15 wherein the tank assembly 20 is mounted to a frame 40. The frame 40 includes a base 43 (which also serves as an air tank), which has a proximal and distal ends, a longitudinal sides, a top and a bottom. The base has wheels 49(*a–d*) best seen in FIG. 6 on its bottom to facilitate movement over a large area.

Figure 2:
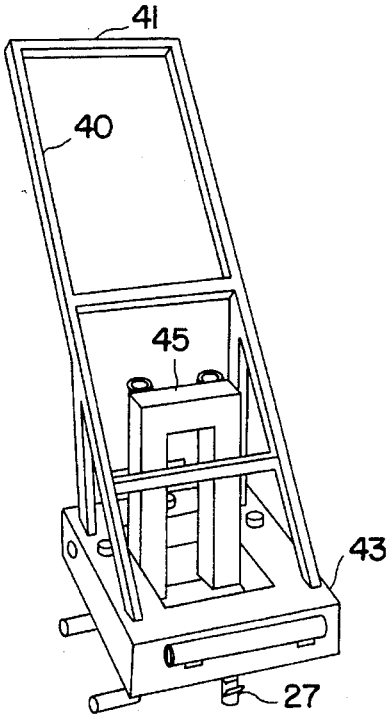
FIG. 2 is a frontal view of the frame of the invention.
Figure 3:
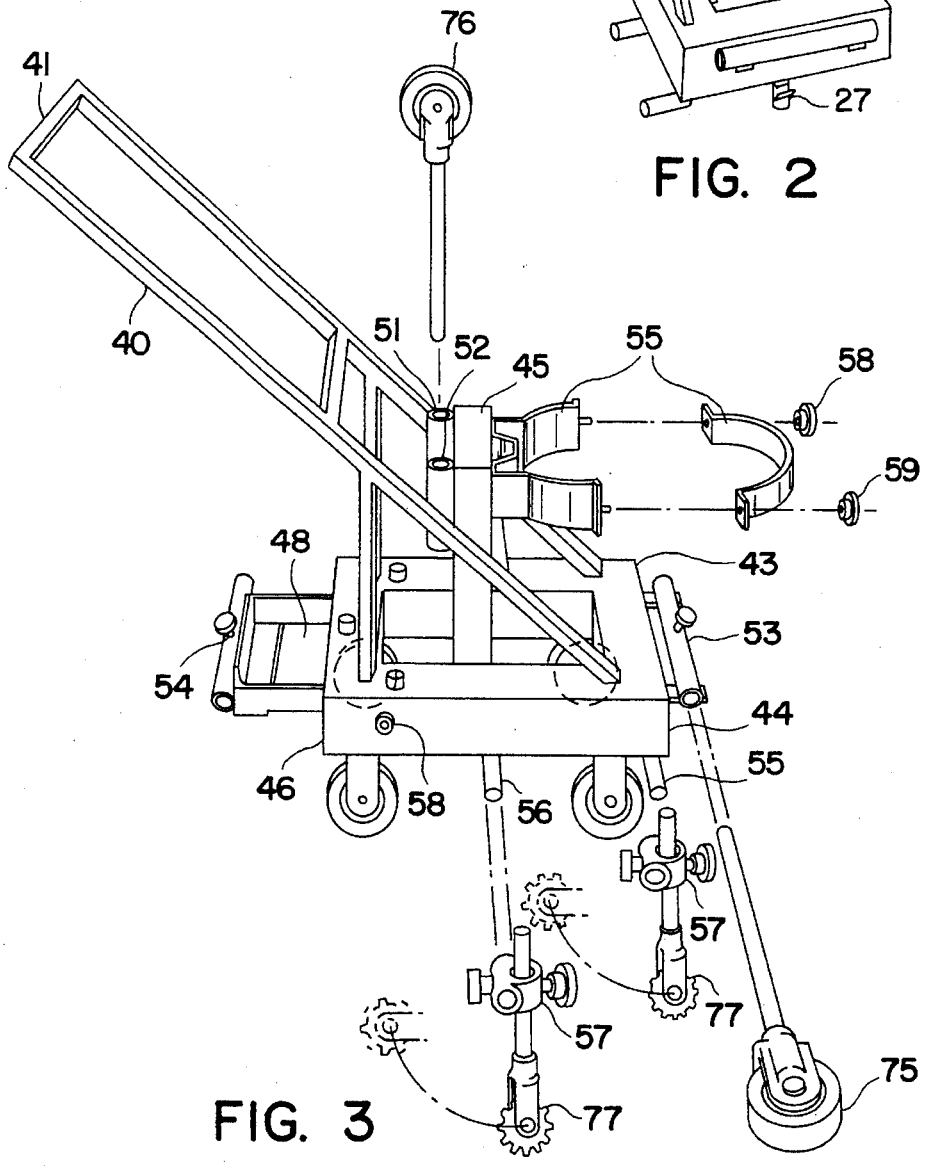
FIG. 3 is an exploded side view of FIG. 1 showing the guiding elements.
Figure 4:
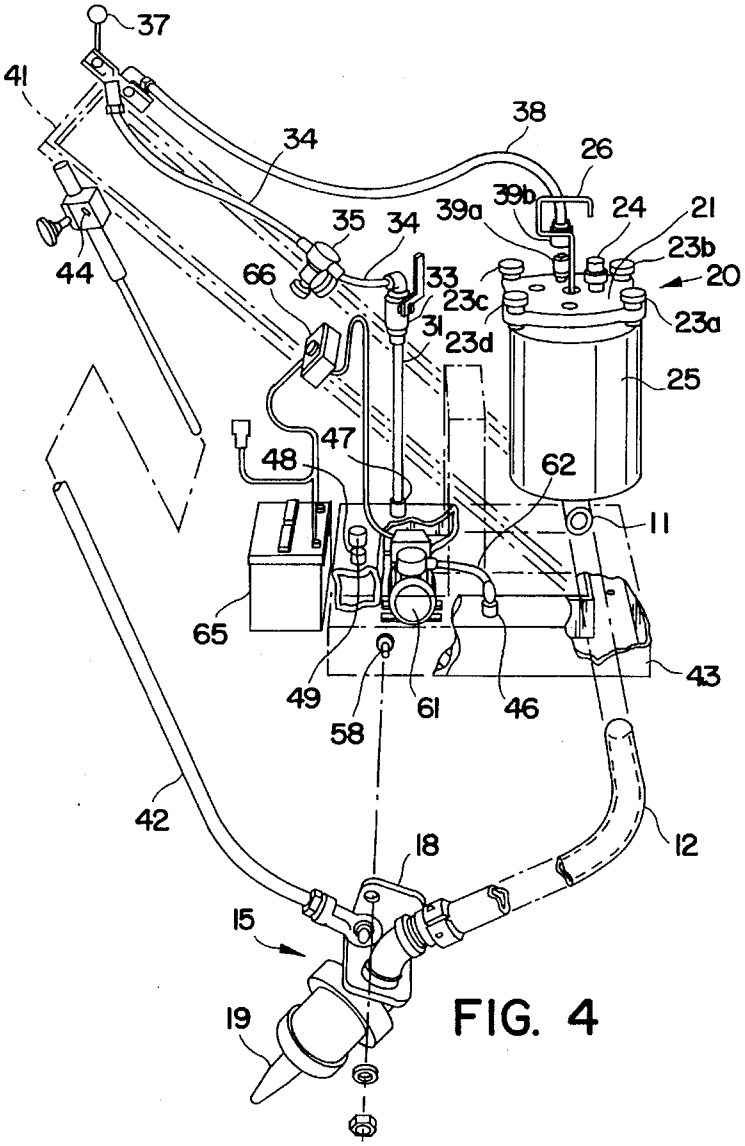
FIG. 4 is an exploded parts view of the caulking assembly shown in FIG. 1.

With reference to FIGS. 2–4 of the drawings, the exemplary embodiment of the present invention generally comprises a frame weldment 40 including a base 43 with a handle 41 attached to the proximal end 44 of the base and which extends upwardly and distally beyond the distal end 46 of the base 43. A battery box 48 is attached to the distal end 46 of the base 43 for holding a battery 65 away from the base 43. An upright member 45 is connected to the base 43, containing two fittings or holders 51, 52 as seen in the drawings. However, it may contain more or less fittings without moving away from the spirit of the invention. Furthermore, the upright 45 has a circular tank clamp 55 for holding the tank 25 which may be loosened or tightened by adjusting the knobs 58, 59.

A fitting 53 is located on the proximal end 44 of the base 43, and another fitting 54 is located on the battery box 48 for attaching a guiding means such as guide-wheels 75, 76. On a longitudinal side of base 43 and extending outwardly as best shown in FIG. 2 are two holders 55, 56 for attaching a joint follower 77 by a pivot connector 57 so that the joint follower 77 can be adjusted. The crack follower is made of a rod with a forked member at an end containing a toothed wheel mounted therein. For best results, it is suggested to use at least two joint followers 77, however only one may be used.

A nozzle pivot 58 is also located on the side of the base 43 for pivotally mounting the nozzle assembly 15. The nozzle pivot 58 may be a threaded aperture as shown, an axial rod or any other means capable of serving the same function. The nozzle 15 as best seen in FIG. 4 has a tip 19 with an aperture, which may be removable and interchangeable with different sized tips, or it may be permanently attached. The tip 19 may be attached by screw threads, bayonet mount or any other like means of attachment.

Referring to FIG. 4, it is seen that base 43 is a hollow member which also serves as an air tank for storing compressed air. The air tank has an air inlet 46, an air outlet 47, a tank drain 27 (FIG. 2) and a pressure relief valve 49 mounted on a third outlet 48.

A compressor 61 is mounted on the air tank 43 for filling the tank with compressed air. The compressor 61 is connected to the air tank 43 by a hose 62 attached to an inlet 46. The compressor 61 is powered by a battery 65 or it may be powered by a gas engine not shown.

The battery 65 is connected to the compressor 61 and to a battery charging device 66, which converts AC current to DC current and allows the battery to be plugged into any electrical outlet to be recharged. The battery is set back away from the tank 43 on the battery box 48 to prevent battery acid from contacting and corroding the air tank 43. Alternatively, the air tank 43 may be filled with compressed $CO_2$ or a $CO_2$ tank may be attached.

A pipe 31 is connected to an outlet 47 and a male air valve 33 for opening and closing the air pathway is attached to the end of the pipe. The male air valve 33 allows the system to be shut-off to isolate the air tank 43 during non-use. An air regulator and gauge 35 for regulating air pressure is mounted on the handle 41 and is interconnected between the male air valve 33 and another valve 37 which is also attached to the handle 41, via tubing 34. The air regulator and gauge 35 are preferably mounted on the handle 41, such that an operator can see the air regulator and gauge 35 when operating the air powered caulker. The valve 37 is interposed between the caulking tank and the air source to allow the operator to open or stop the caulking flow. Another tube 38 connects the valve 37 to the caulking tank assembly 20, both tubings 34 and 38 may be polypropylene tubing such as POLY-FLO TUBING, able to withstand 350 PSI.

The tank assembly 20 has a caulking tank 25 and a lid 21, wherein the tube 38 is connected to the lid 21 by a connector such as a quick disconnect or the like. Preferably, the female half 39*b* of the of the connector is mounted on the end of tube 38 and the male half 39*a* of the connector is mounted on the lid 21. Clamps 23(*a–d*) securely hold the lid 21 onto the caulking tank 25 for an air tight seal. The clamps 23(*a–d*) are preferably of the knob type but others types may also be used, and more or less than four clamps 23(*a–d*) may also be used but four has been found to be give a secure seal. An adjustable vent 24 is attached to the lid 21 to allow excess pressure to escape from the tank 25.

In the principle embodiment, air pressure is used to force the material out of the tank 25 through an outlet 11 located on the bottom of the tank, and a pressurized paint sprayer tank may be used for the tank 25. A lifting handle 26 is attached to the lid 21 for lifting the lid to refill the tank.

Alternatively, a piston (not shown) may be adapted to reciprocate within the tank 25, and the piston could be attached to the lifting handle 26, which would pass through an aperture in the lid 21.

The outlet 11 is connected to a hose, such as a NYLO-BRAID hose, and the hose 12 connects to the nozzle assembly 15 creating a fluid pathway for the caulking. The nozzle 15 is designed to break away instead of causing serious damage in case the tip 19 strikes a immovable object. The nozzle 15 is connected to a L-shaped bracket 18, illustrated in the drawings as integral. However, it may be a separate element, which is pivotally mounted on the base upon a pivot 58.

An adjustment rod 42 is connected at its lower end to the bracket 18, and at its upper end, it is slidably connected to a handle 41 through a joint 44. Advantageously, the operator of the air powered caulker is able to raise and lower the tip 19, without having to stop and bend over to adjust the nozzle.

As seen in reference to FIG. 4, bracket 18 can be detached from the frame. The detachment feature permits an operator to quickly disengage the nozzle assembly 15 from the frame and hand manipulate and position the nozzle assembly. This permits the apparatus to be used in caulking tight areas or joints otherwise not accessible by the fixed mounted nozzle. If desired, adjusting rod 42 can also be separated from bracket 18 to permit even greater flexibility of the nozzle assembly 15.

An additional embodiment of the present invention is directed toward providing an air-driven, piston actuated caulking dispenser and nozzle which will hold standard cartridges and can be driven by the compressed air source of the air-powered caulking apparatus. A separate nozzle assembly and caulking apparatus can be provided similar to that seen in U.S. Pat. No. 3,813,012, which is incorporated herein by reference. As seen in the above referenced patent, the air-powered dispenser is provided to receive and support cartridges of caulking material. A supply of pressurized air is received by the dispenser and applied against the cartridge plunger to cause discharge of the centrifuge material. While the above referenced Laird patent discloses a gun-shaped dispenser, the dispenser apparatus can be provided having a over-all cylindrical shape by positioning the handle and trigger mechanism seen in Laird to the rear of the dispenser so that the over-all shape of the dispensing apparatus is linear.

In operation, the poly-flo tubing 38 is disengaged at quick disconnect 39 which is then used to engage the connector of the cartridge dispenser. This optional feature permits the caulking apparatus of the present invention to alternate between various types of caulk. The above cartridge dispenser can be used as a hand held unit for finishing and detail work, the trigger mechanism of the cartridge dispenser being used to regulate the pressure and flow rate of the caulk. Alternatively, the cartridge dispenser can be mounted through a suitable bracket to the frame of the caulking apparatus in a fashion similar to that seen for the nozzle assembly 15. In this latter embodiment, the adjusting rod 42 and in valve 37 can be used to regulate the flow rate of the cartridge dispenser by providing a well-known trigger lock mechanism to the cartridge dispenser. When so locked in an engaged position, the cartridge dispenser will respond to the air-pressure regulation of the apparatus similar to that previously described for nozzle assembly 15.

Figure 5:
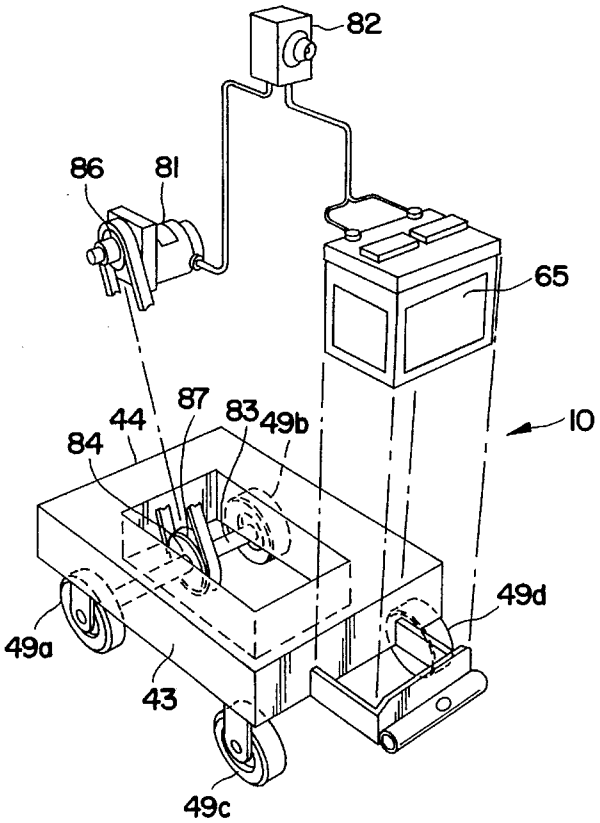
FIG. 5 is a partial exploded parts view showing another embodiment of the invention.

Referring to FIG. 5, the principle embodiment is seen wherein the air powered caulker 10 is self powered by an electric motor 81. In another embodiment (not shown), the air powered caulker 10 is powered by a gasoline engine.

In this embodiment, an electric motor is mounted on the base 43 and is connected to the battery 65 via a speed control device 82 such as a rheostat. A sprocket 84 is connected to a drive axle 83 that connects the wheels 49(*a–b*) on the proximal end 44. Another sprocket 86 is connected to the motor 81, and the motor sprocket 86 and the axle sprocket 84 are connected by a drive belt or chain 87 which engages them. As the motor sprocket 86 rotates, the belt is moved, thus driving the axle sprocket 84 and the drive axle 83 which rotates the wheels 49(*a–b*), thus moving the apparatus. Other well known gears, transmission, or drive belts could be used to drive the apparatus.

In operation the caulking material is preferably poured into the tank 25, however it may also be in a manufactured cartridge or bag loaded into the tank, or it may be mixed directly in the tank. Next, the lid 21 is secured by the clamps 23(*a–d*) to the tank 25 and the air hose is attached to the lid. The air compressor 61 is started, and the operator may adjust the height of the nozzle assembly 15. After the pressure builds up in the air tank 43, the operator may open the male air valve 33 and the apparatus is ready for operation. The operator may regulate the flow of caulking by adjusting the air pressure, which is done by adjusting the air regulator.

While it is preferred to extrude the caulking under air pressure, it is also within the scope of the invention to use other extrusion means such as an auger mounted within the tank or nozzle to extrude caulking. A feature not shown in the drawings is the application of a strip of filler which would go into the joint prior to the caulking material. Next, the speed of the air powered caulker 10 is adjusted, and the device is ready for use by opening valve 37 to start the flow of caulking.

In a second embodiment a gasoline powered engine is used instead of a battery 65 to power both the air compressor 61 and to propel the air powered caulker 10. In this embodiment, the engine may directly power both the compressor and the drive mechanism, or it may indirectly power one of the elements by charging a battery.

In a third embodiment, the air powered caulker 10 does not contain a drive mechanism, and it is manually pushed. It is believed that no further explanation is necessary to explain this embodiment.

While only a particular and preferred embodiment of the present invention has been illustrated herein, it will be readily apparent to persons skilled in the art that numerous changes and modifications may be made thereto without departing from the spirit of the invention. Accordingly, the foregoing disclosure and description thereof are for illustrative purposes only and do not in any way limit the invention which is defined only by the following claims.

That which is claimed is:

1. A dispenser for dispensing a flowable sealant material, comprising, in combination:

a nozzle, an extruder;

a sealant tank with an outlet located at one end, which is operatively connected to said nozzle, and whereby said extruder acts on said sealant stored in the sealant tank forcing said sealant through said nozzle, a frame having a proximal and distal end, a top, a bottom and two longitudinal sides, said frame supporting said sealant tank and said nozzle, at least one toothed guide wheel carried by said frame for guiding said dispenser along a joint, a regulator for controlling said extruder, a handle attached to said frame which extends upwards and away from said frame, said regulator is attached to said handle, at least two wheels attached to the bottom of said frame, and wherein said frame supports said nozzle along a pivot on one of said longitudinal sides of said frame.

2. The dispenser according to claim 1 wherein said at least one toothed guide wheel is mounted on the same longitudinal side as said nozzle for guiding said nozzle along a joint.

3. The dispenser according to claim 2 further comprising a motor for propelling said dispenser.

4. The dispenser according to claim 1, wherein said extruder further comprises an air tank defined in part by said frame, said sealant tank has a lid secured to a top of said tank to create an air-tight seal, said regulator is a valve operatively interposed between an air source within said air tank and said sealant tank.

5. The dispenser according to claim 4 further comprising a second tooth guide wheel mounted on the same longitudinal side as said nozzle for guiding said nozzle along a joint.

6. The dispenser according to claim 5, wherein said lid is secured to said caulking tank by a plurality of clamps.

7. The dispenser according to claim 5, wherein said air source further includes a compressor mounted on said air tank and operatively connected therewith.

8. The dispenser according to claim 7, further including a power supply for supplying power to said compressor.

9. The dispenser according to claim 7, further including a male air valve and an air regulator and gauge operatively connected between said valve and said air tank for opening and closing an air pathway and regulating the pressure respectively.

10. The dispenser according to claim 8, wherein the power supply is a battery, said battery mounted on a battery box attached to the distal end of said air tank.

11. The dispenser according to claim 7 further comprising a pressure release valve on said air tank and a vent to release excess pressure on said caulking tank.

12. The dispenser according to claim 5 further comprising a motor for propelling said dispenser.

13. The dispenser according to claim 12, wherein the motor is an electric motor connected to at least one wheel by a drive mechanism.

14. An air powered caulker for dispensing caulking, comprising, in combination:

a nozzle assembly comprising a dispensing tip in fluid communication with a source of caulking, a source of air, a caulking tank operatively interposed between said nozzle and said air source, said caulking tank having an open top end and a bottom including a lid secured to the top of the caulking tank to create an air-tight seal and wherein an outlet operatively connected to said nozzle assembly is located at said bottom, and wherein said caulking stored in said caulking tank is extruded through said outlet and said dispensing tip by compressed air entering said tank, a valve operatively interposed between said air source and said caulking tank for regulating the amount of air passing to said caulking tank and thus controlling the flow of caulking, wherein said air source further comprises an air tank having a proximal and distal end, a top, a bottom and at least two longitudinal sides and a compressor mounted on said air tank and operatively connected therewith, said air tank further defines a support for said caulking tank, a power source attached to said air tank and said power source is operatively connected to said compressor, a handle attached to said air tank which extends upwards and away from said air tank, said valve is attached to said handle, at least two wheels attached to the bottom of said air tank, and wherein said nozzle is pivotally mounted on one of said longitudinal sides of said air tank and has an adjustment rod extending from said nozzle to a nozzle adjusting rack mounted on said handle for adjusting a position of said nozzle assembly and at least one guiding means mounted on the same longitudinal side as said nozzle for guiding said nozzle along a crack.

15. The air powered caulker according to claim 14, wherein it has a motor for propulsion.

16. The air powered caulker according to claim 15, wherein said motor is an electric motor connected to at least one wheel by a gear mechanism.

17. The air powered caulker according to claim 14, further including a male air valve and an air regulator and gauge operatively connected between said valve and said air tank for opening and closing an air pathway and regulating the pressure respectively.

18. The air powered caulker according to claim 14, wherein said air tank further includes a pressure release valve and said caulking tank includes a vent to release excess pressure.

19. The air powered caulker according to claim 14 further comprising a battery charging means for recharging a battery.

* * * * *